US008770986B2

(12) United States Patent
Furness et al.

(10) Patent No.: US 8,770,986 B2
(45) Date of Patent: Jul. 8, 2014

(54) DEVICES, KITS, AND METHODS FOR SUPPLEMENTING RETAINING FORCES ON MATABLE DEVICES SUCH AS ELECTRICAL CONNECTORS

(75) Inventors: Richard Furness, Kent, NY (US); Wojciech Mysliwiec, Rochester, NY (US)

(73) Assignee: Harris Corporation, Melbourne, FL (US)

( * ) Notice: Subject to any disclaimer, the term of this patent is extended or adjusted under 35 U.S.C. 154(b) by 247 days.

(21) Appl. No.: 13/439,395

(22) Filed: Apr. 4, 2012

(65) Prior Publication Data

US 2013/0267101 A1 Oct. 10, 2013

(51) Int. Cl.
*H01R 11/30* (2006.01)

(52) U.S. Cl.
USPC ..... 439/39; 439/906

(58) Field of Classification Search
USPC ..... 439/38–40, 901–906
See application file for complete search history.

(56) References Cited

U.S. PATENT DOCUMENTS

| | | | | |
|---|---|---|---|---|
| 5,385,476 | A * | 1/1995 | Jasper | 439/38 |
| 8,177,560 | B2 * | 5/2012 | Rohrbach et al. | 439/39 |
| 8,497,753 | B2 * | 7/2013 | DiFonzo et al. | 335/205 |
| 8,535,088 | B2 * | 9/2013 | Gao et al. | 439/490 |
| 8,690,582 | B2 * | 4/2014 | Rohrbach et al. | 439/39 |

OTHER PUBLICATIONS

USB Connector Magnetic. Datasheet [online]. Shenzhen Palyoo Electronics Co., Ltd. [retrieved on Jul. 24, 2012] Retrieved from the Internet: http://www.alibaba.com/product-gs/427126874/USB_connector_magnetic.html.

2.0 B Type USB Connector Magnetic, Datasheet [online] Dongguan Topsun Electronics Co., Ltd. [retrieved Jul. 24, 2012]. Retrieved form the Internet: http://dgtopsun.en.alibaba.com/product/481450866-212690475/2_0_B_Type_USB_B_Type_Female_Connector.html.

4 pin SMT USB electric magnetic socket connector, Datasheet [online]. dongguan Clty Jianghan Electronics Co., Ltd., [retrieved on Jul. 29, 2012]. Retreived from the Internet: <<hppt://www.alibaba.com/product-gs/370149240/4_pin_SMT_USB_electric_magnetic.html>>.

* cited by examiner

*Primary Examiner* — Khiem Nguyen
(74) *Attorney, Agent, or Firm* — Fox Rothschild, LLP; Robert J. Sacco

(57) ABSTRACT

Kits, devices, and methods are provided for increasing a retaining force on a first device configured to mate with a second device to establish an electrical connection between the first and second devices. The first device can be, for example, a plug-type electrical connector (15), and the second device can be, for example, a receptacle connector. Magnets (100) can be mounted on or proximate one of the connector (15) and receptacle (16), and a ferromagnetic element in the form of a plate member (14) can be mounted on or proximate the other of the connector (15) and receptacle (16) so that magnetic attraction between the magnetic elements (100) and the ferromagnetic element (14) urges the connector (15) toward the receptacle (16) when the connector (15) and the receptacle (16) are mated. Existing electrical connectors can thus be retrofit so as to increase the retaining force thereon.

13 Claims, 12 Drawing Sheets

DEVICES, KITS, AND METHODS FOR SUPPLEMENTING RETAINING FORCES ON MATABLE DEVICES SUCH AS ELECTRICAL CONNECTORS

BACKGROUND OF THE INVENTION

1. Statement of the Technical Field

The inventive arrangements relate to devices, such as electrical connectors, that mate with each other to establish an electrical connection therebetween.

2. Description of Related Art

Electrical connectors, such as universal serial bus (USB) connectors, are commonly used to electrically connect two or more electronic devices to each other. USB connectors take the form of plug connectors, and receptacle connectors. A USB plug connector can include a body, and a mating portion that extends from the body. The mating portion is configured to be received by the receptacle. Electrical contacts within the mating portion contact associated electrical contacts in the receptacle to establish an electrical connection between the plug connector and the receptacle.

Friction between the contacting surfaces on the plug connector and its receptacle results in a force on the plug that resists separation, or de-mating, of the plug from the receptacle. This force is commonly referred to as a "retaining force." Because USB connectors are relatively compact, the net frictional force between the contacting surfaces of the plug connector and the receptacle is low, which in turn makes the retaining force on the plug connector low, e.g., on the order of one pound or less.

The relatively low retaining force on a typical USB plug connector often results in accidental or otherwise unintentional de-mating of the plug connector from its receptacle, which in turn results in a loss of connectivity between the devices being interconnected by way of the plug connector and receptacle. For example, accidentally pulling a cable connected to a USB plug connector with even a low level of force can cause the plug connector to partially or fully de-mate from its receptacle. Although provisions such as latches, catches, fasteners, etc. can be implemented to reduce or eliminate accidental de-mating, such provisions are impractical in many applications due to factors such as a lack of space on many portable electronic devices; the requirement in many applications for "beak away capability," i.e., the ability to quickly and easily de-mate the plug connector and receptacle; and potential user resistance to the extra time and effort needed to manipulate fasteners, latches, catches, etc. each time the plug connector is mated and de-mated.

SUMMARY OF THE INVENTION

Embodiments of kits are provided for supplementing a retaining force between an electrical connector and a receptacle of a computing device. The kits include a shell. The shell includes a body having a first half and a second half configured to mate with the first half; and a magnet mounted on the body. The first half and the second half of the body, when mated, define a cavity configured to receive at least a portion of the electrical connector in a manner that prevents substantial relative movement between the electrical connector and the body. The kits further include a ferromagnetic element configured to be mounted on the computing device proximate the receptacle so that the magnet is operable to attract the ferromagnetic element when the electrical connector and the receptacle are mated.

In accordance with a further aspect of the claimed inventive concepts, embodiments of shells are provided for exerting a retaining force on a first device configured to mate with a second device to establish an electrical connection between the first and second devices. The shells include a body having a first half and a second half. The first and second halves are configured to be mated on a non-permanent basis. The first and second halves are further configured so that the first and second halves, when mated, define a cavity that receives at least a portion of the connector. The cavity has a periphery that substantially matches a shape of an exterior of the portion of the connector received therein. The shells further include at least one of a magnet and a ferromagnetic element mounted on the body. The magnet or the ferromagnetic element is configured to urge the shell in a mating direction of the first device when the magnet or ferromagnetic element interacts magnetically with another magnet or ferromagnetic element located proximate the second device.

In accordance with a further aspect of the claimed inventive concepts, kits are provided for increasing a retaining force between a first device and a second device configured to mate with the first device to establish an electrical connection between the first and second devices. The kits include a shell having a body configured to be assembled around at least a portion of the first device. The body is further configured to restrain the first device from substantial movement in relation to the body when the body is assembled around the first device. The kits further include a magnet and a ferromagnetic element. One of the magnet and the ferromagnetic element is mounted on the body and forms a part of the shell. The other of the magnet and the ferromagnetic element is configured to be mounted proximate the second device. The magnet and the ferromagnetic element are operable to generate a force that urges the first device toward the second device when the first and second devices are mated.

In accordance with a further aspect of the claimed inventive concepts, methods are provided for supplementing a retaining force between a first device and a second device configured to mate with the first device to establish an electrical connection between the first and second devices. The methods comprise providing a shell having a body that includes a first half and a second half configured to mate with the first half. The shell also includes at least one of a magnet and a ferromagnetic element mounted on the body. The methods further include placing the first device on a first half of the body, and aligning a second half of the body with the first half of the body. The methods also include bringing the first and second halves of the body into contact so that the first device becomes disposed in a cavity defined by the first and second halves, and securing the first half of the body to the second half of the body.

BRIEF DESCRIPTION OF THE DRAWINGS

Embodiments will be described with reference to the following drawing figures, in which like numerals represent like items throughout the figures and in which.

DETAILED DESCRIPTION

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

Figure 1A:
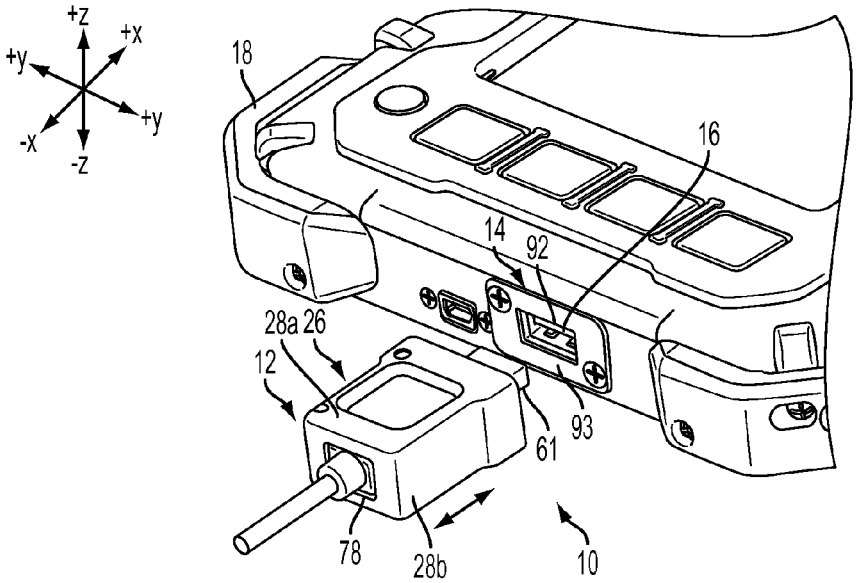
FIG. 1A is a perspective view of a kit for increasing a retaining force on an electrical connector, depicting a shell of the kit installed on the connector, further depicting a plate member of the kit installed on a notebook computer, and further depicting the connector in the process of being mated with a receptacle of the notebook computer.
Figure 12:
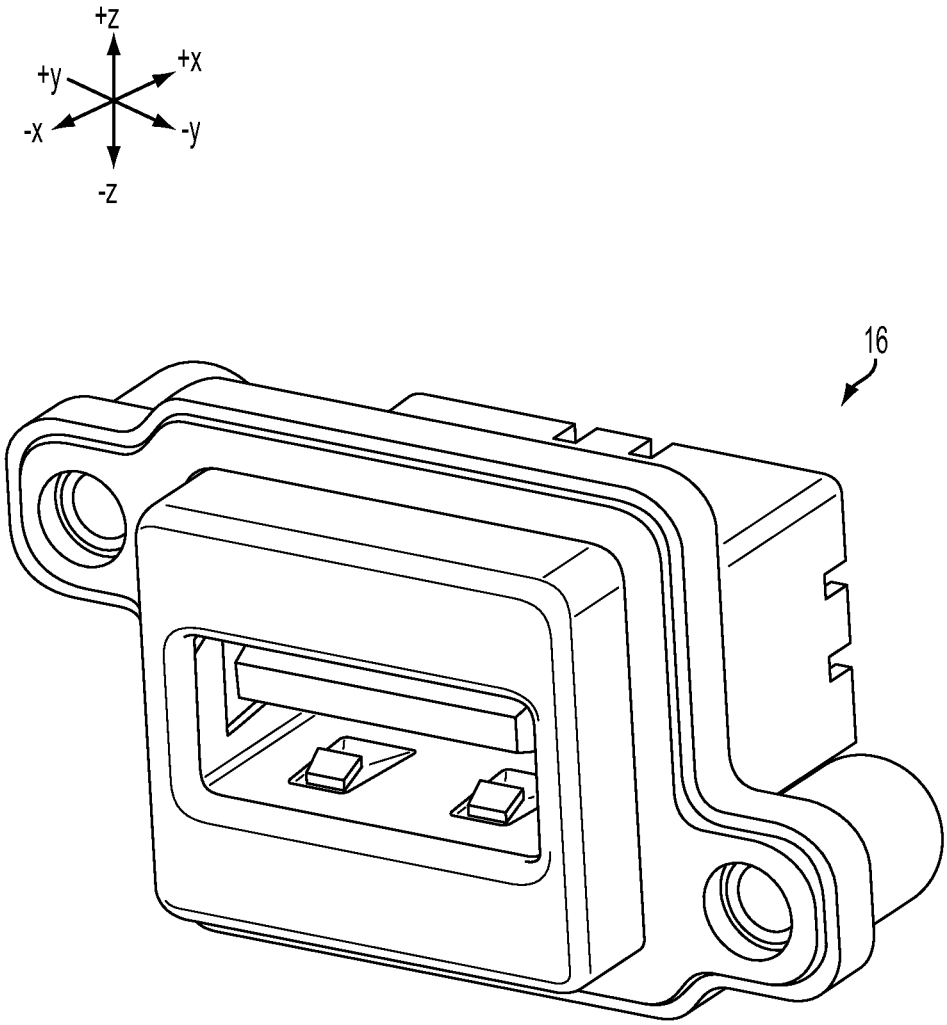
FIG. 12 is a perspective view of a receptacle of the notebook computer shown in FIGS. 1A-2.

The figures depict a kit 10 for increasing the retaining force on a connector. The kit 10 comprises a housing or shell 12, and a ferromagnetic element in the form of a plate member 14, as shown in FIG. 1A. The shell 12 can be installed on an electrical connector 15, as shown in FIGS. 1A-6. The connector 15 is a USB standard type A plug connector. The connector 10 is configured to mate with a USB standard Type A receptacle 16 mounted on a computing device such a notebook computer 18, as shown in FIG. 1A. The receptacle is also depicted in FIG. 12. The plate member 14 is mounted on the notebook computer 18, as illustrated in FIG. 1A. Magnetic attraction between the shell 12 and the plate member 14 helps to maintain the connector 10 in a mated condition with the receptacle 16.

The use of the shell 12 and the plate member 14 in conjunction with a USB plug connector 15 and a notebook computer 18 is described for exemplary purposes only. The shell 12 can be configured for use with other types of connectors, and with devices other than connectors, such as thumb drives. Moreover, the plate member 14 can be configured for mounting on devices other than notebook computers.

The shell 12 is formed from a non-magnetizable material such as high-impact plastic. The shell 12 comprises a body 26 having a first half 28*a*, and a substantially identical second half 28*b*, as shown in FIGS. 4-9B. The first half 28*a* is configured to be mated with, and de-mated from the second half 28*b*. The shell 12, when assembled, defines an internal volume or cavity 50 that accommodates the connector 15. The cavity 50 is depicted in part in FIG. 8. The first and second halves 28*a*, 28*b* are configured so that the shape of the cavity 50 approximates the outer contours of a body 60 the connector 15.

Figure 7:
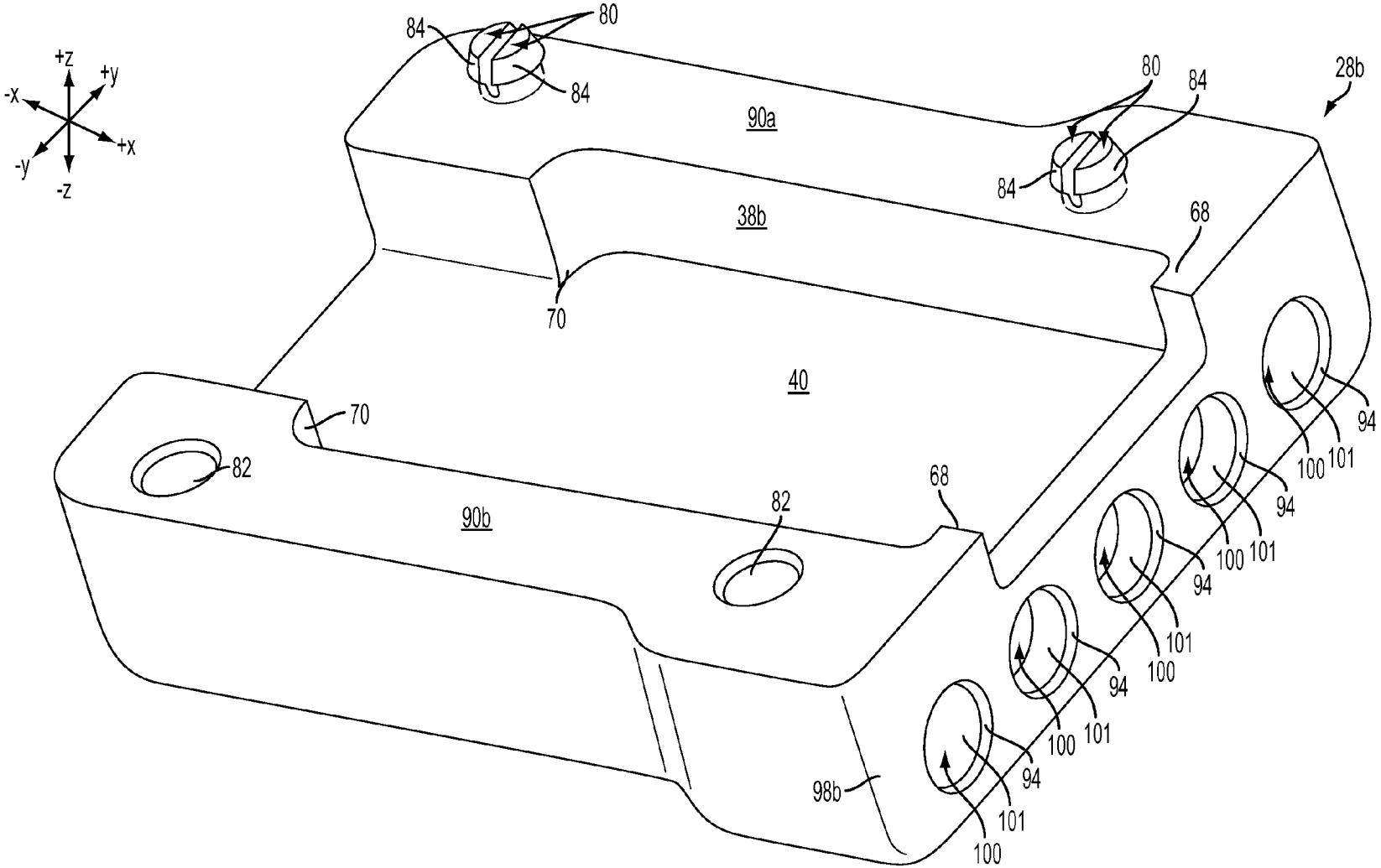
Figure 9A:
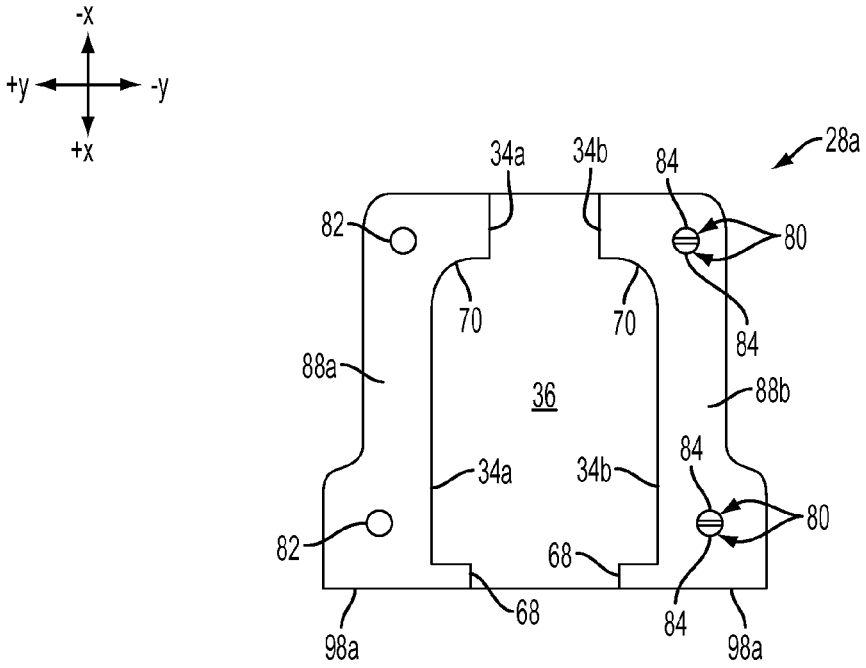
FIGS. 9A and 9B are bottom views of a respective first and second half of the shell shown in FIGS. 1A-8.
Figure 9B:
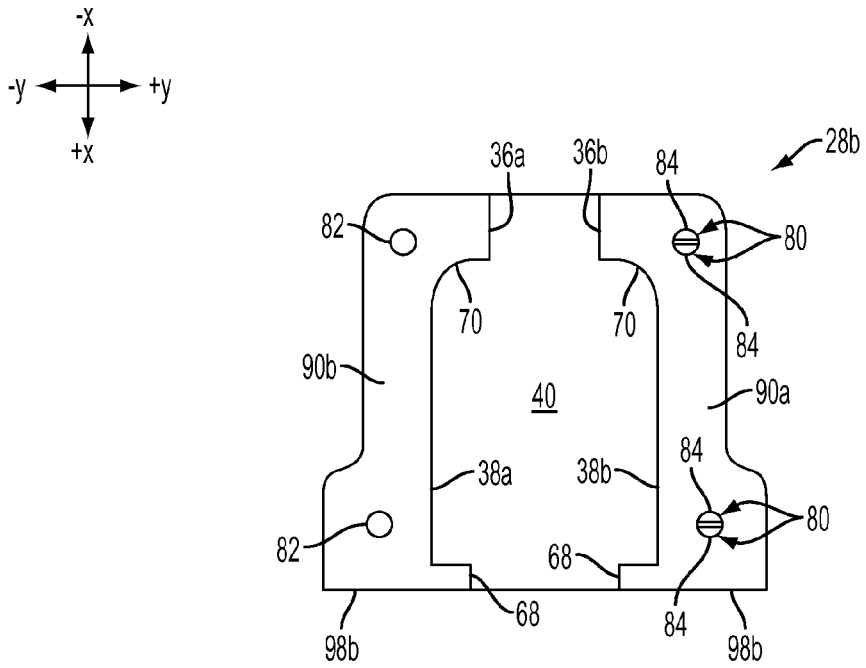

The first half 28*a* has a side surface 34*a*, a opposing side surface 34*b*, and a lower surface 36 on an underside thereof, as shown in FIG. 9A. The lower surface 36 adjoins, and is substantially perpendicular to the side surfaces 34*a*, 34*b*. The second half 28*b* has a side surface 38*a*, an opposing side surface 38*b*, and a lower surface 40 on an underside thereof, as shown in FIGS. 7 and 9B. The lower surface 40 adjoins, and is substantially perpendicular to the side surfaces 38*a*, 38*b*.

Figure 4:
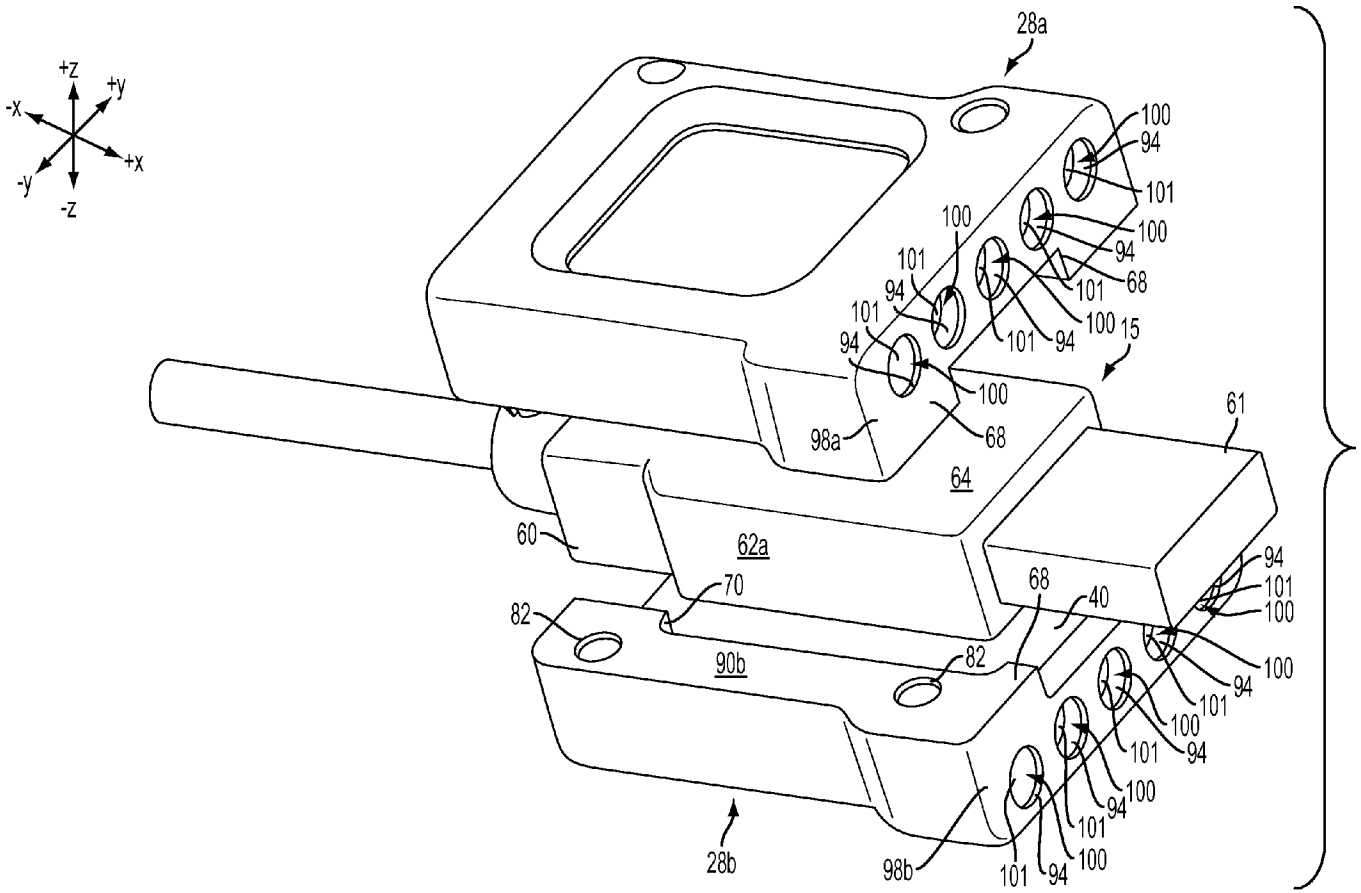
FIGS. 4-7 are perspective views of the shell and the electrical connector shown in FIGS. 1A-3, depicting the shell in exploded view.
Figure 5:
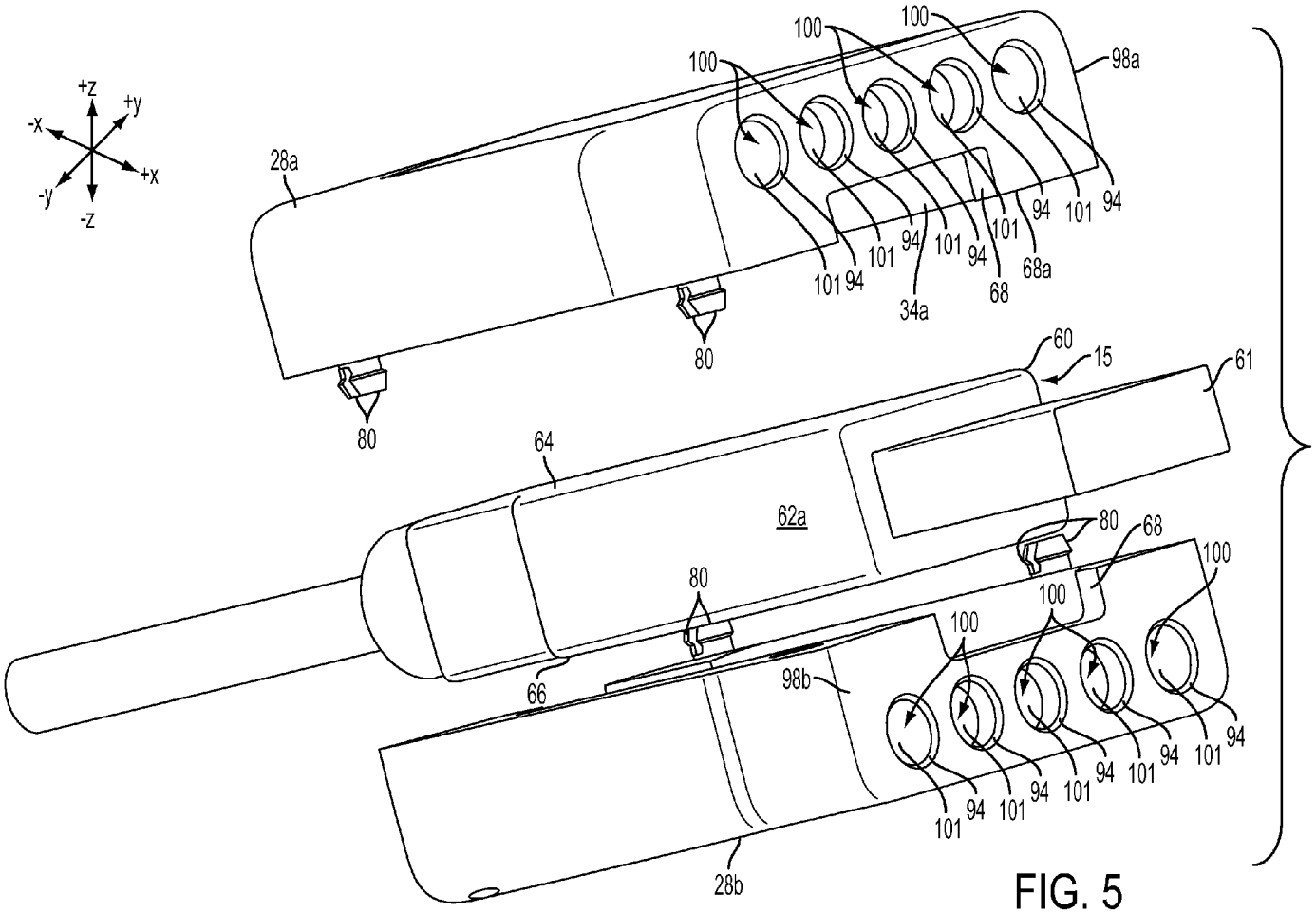
Figure 6:
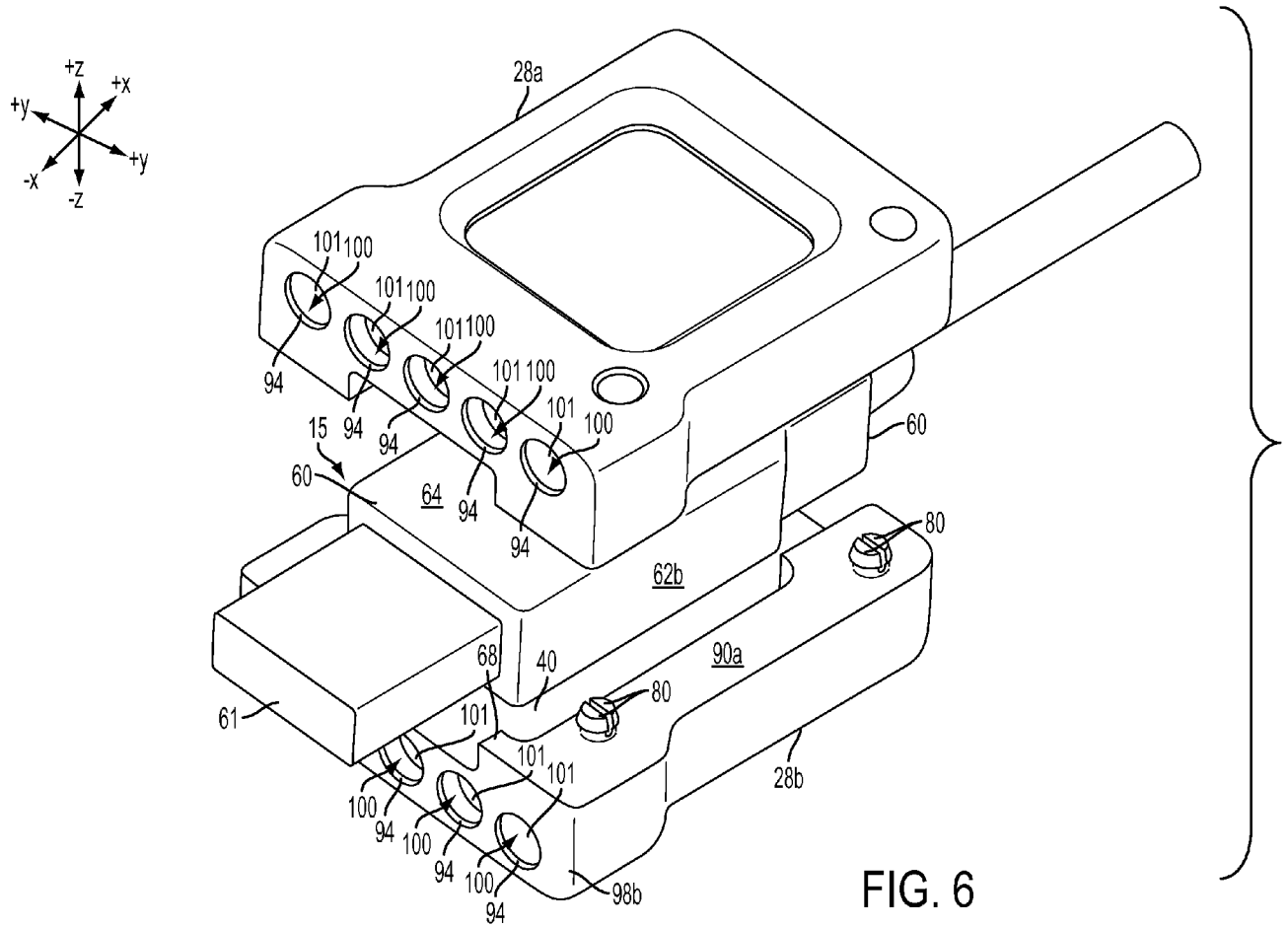

The side surface 34*a* of the first half 28*a* of the shell 12 substantially aligns with the side surface 38*a* of the second half 28*b* when the first and second halves 28*a*, 28*b* are mated, as depicted in FIGS. 4-6. The side surface 34*b* of the first half 28*a* likewise substantially aligns with the side surface 38*b* of the second half 28*b* when the first and second halves 28*a*, 28*b* are mated. The lower surface 36 of the first half 28*a* is positioned opposite the lower surface 40 of the second half 28*b* when the first and second halves 28*a*, 28*b* are mated.

The side surfaces 34*a*, 34*b*, 38*a*, 38*b*, and the lower surface 36, 40 define the cavity 50 when the first and second halves 28*a*, 28*b* are mated. The cavity 50 is configured to receive the connector 15 in a manner that prevents substantial relative movement between the connector 15 and the shell 12. In particular, the body 60 of the connector 10 has side surfaces 62*a*, 62*b*, a top surface 64, and a bottom surface 66, as shown in FIGS. 4-6. The side surfaces 34*a*, 38*a* of the respective first and second halves 28*a*, 28*b* of the shell 12 are shaped to substantially match the contours of the side surface 62*a* of the connector body 60, as shown in FIGS. 7, 9A, and 9B. The side surfaces 34*b*, 38*b* of the respective first and second halves 28*a*, 28*b* are shaped to substantially match the contours of the side surface 62*b* of the connector body 60.

Moreover, the spacing between the opposing side surfaces 34*a*, 34*b* of the first half 28*a* is slightly greater than the distance between the side surfaces 62*a*, 62*b* of the connector body 60, as shown in FIGS. 4-6. The spacing between the opposing side surfaces 38*a*, 38*b* of the second half 28*b* likewise is slightly greater than the distance between the side surfaces 62*a*, 62*b* of the connector body 60. The side surfaces 34*a*, 34*b*, 38*a*, 38*b* of the shell 12 thus restrain the connector 15 from substantial movement in relation to the shell 12 in the lateral, or "y" direction.

The lower surfaces 36, 40 of the first and second halves 28*a*, 28*b* of the shell 12 are substantially planar, to substantially match the configuration of the top and bottom surfaces 64, 66 of the connector body 60. The spacing between the lower surfaces 36, 40 of the respective first and second halves 28*a*, 28*b* when the shell 12 is assembled is slightly greater than the spacing between the top and bottom surfaces 64, 66 of the connector body 60. The surfaces 36, 40 thus restrain the connector 15 from substantial movement in relation to the shell 12 in the vertical, or "z" direction.

The side surfaces 34*a*, 34*b*, 38*a*, 38*b* each have a lip 68 formed at a forward end thereof, as shown in FIGS. 9A and 9A. The lips 68 are configured to interfere with the forward end of the connector body 60, thereby constraining the connector 15 from substantial forward, or "+x"-direction movement in relation to the shell 12.

Each of the side surfaces 34*a*, 34*b*, 38*a*, 38*b* also includes a curved portion 70 proximate a rearward end thereof, as shown in FIGS. 7, 9A, and 9B. Each curved portion 70 is configured to interfere with a similarly-shaped curved portion on an associated one of the side surfaces 62*a*, 62*b* of the connector body 60, thereby restraining the connector 15 form substantial rearward, or "−x"-direction movement in relation to the shell 12.

Figure 1B:
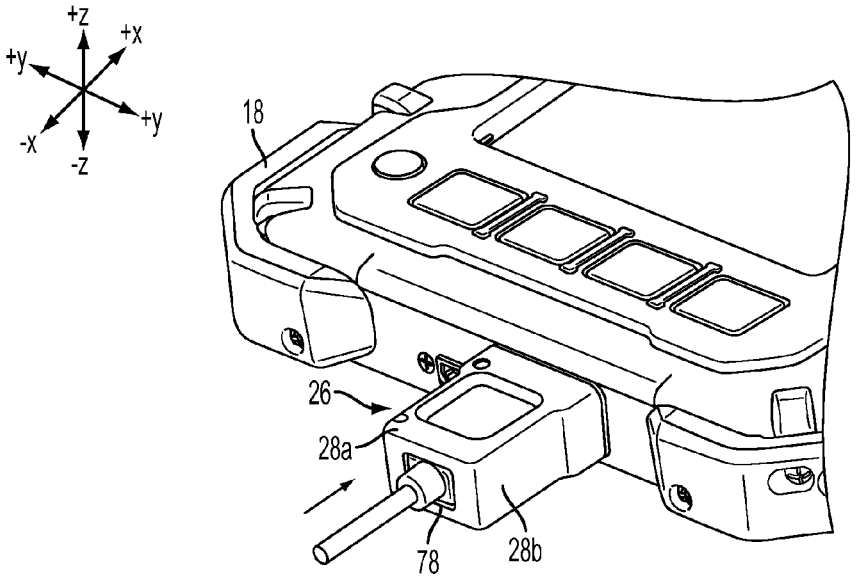
FIG. 1B is a perspective view of the kit and notebook computer shown in FIG. 1A, depicting the electrical connector mated with the receptacle of the notebook computer.
Figure 2:
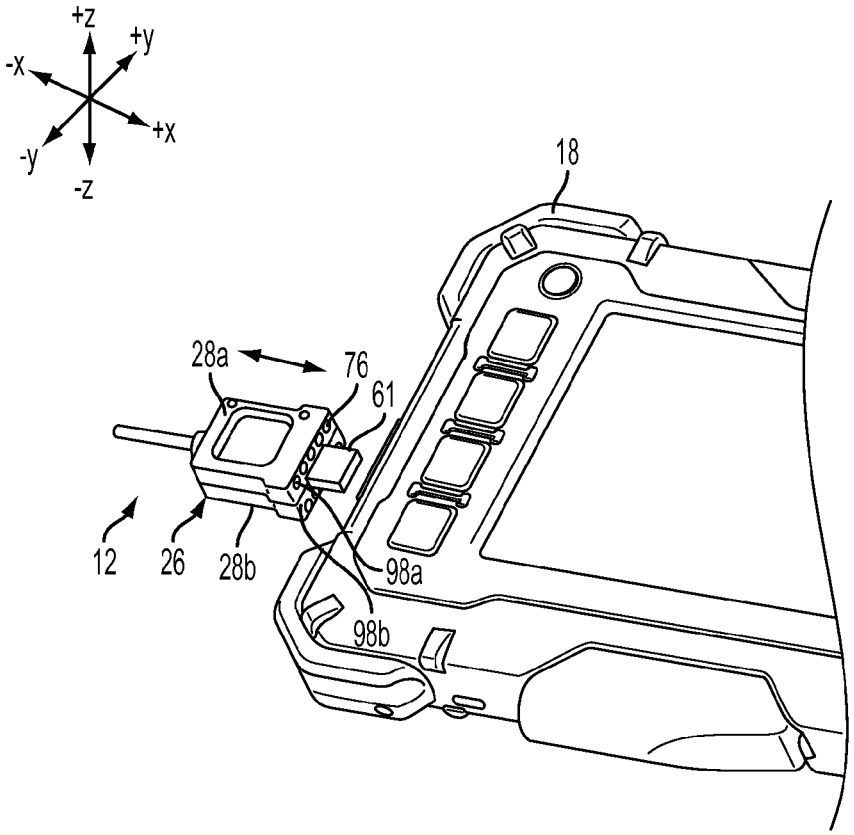
FIG. 2 is another perspective view of the kit and notebook computer shown in FIGS. 1A and 1B, depicting the electrical connector in the process of being mated with the receptacle of the notebook computer.
Figure 3:
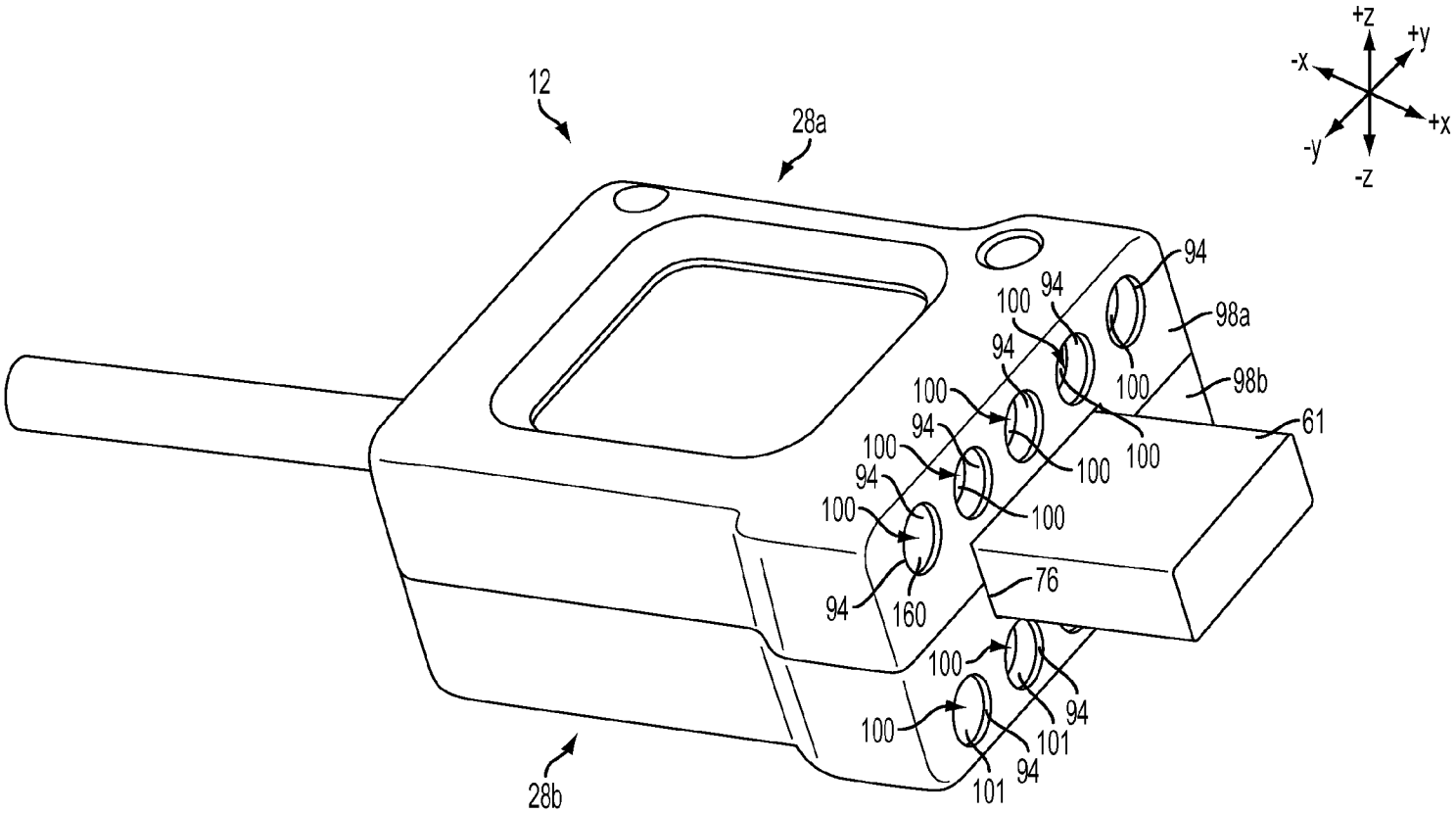
FIG. 3 is a front perspective view of the shell and the electrical connector shown in FIG. 1A, depicting the shell installed on the connector.
Figure 8:
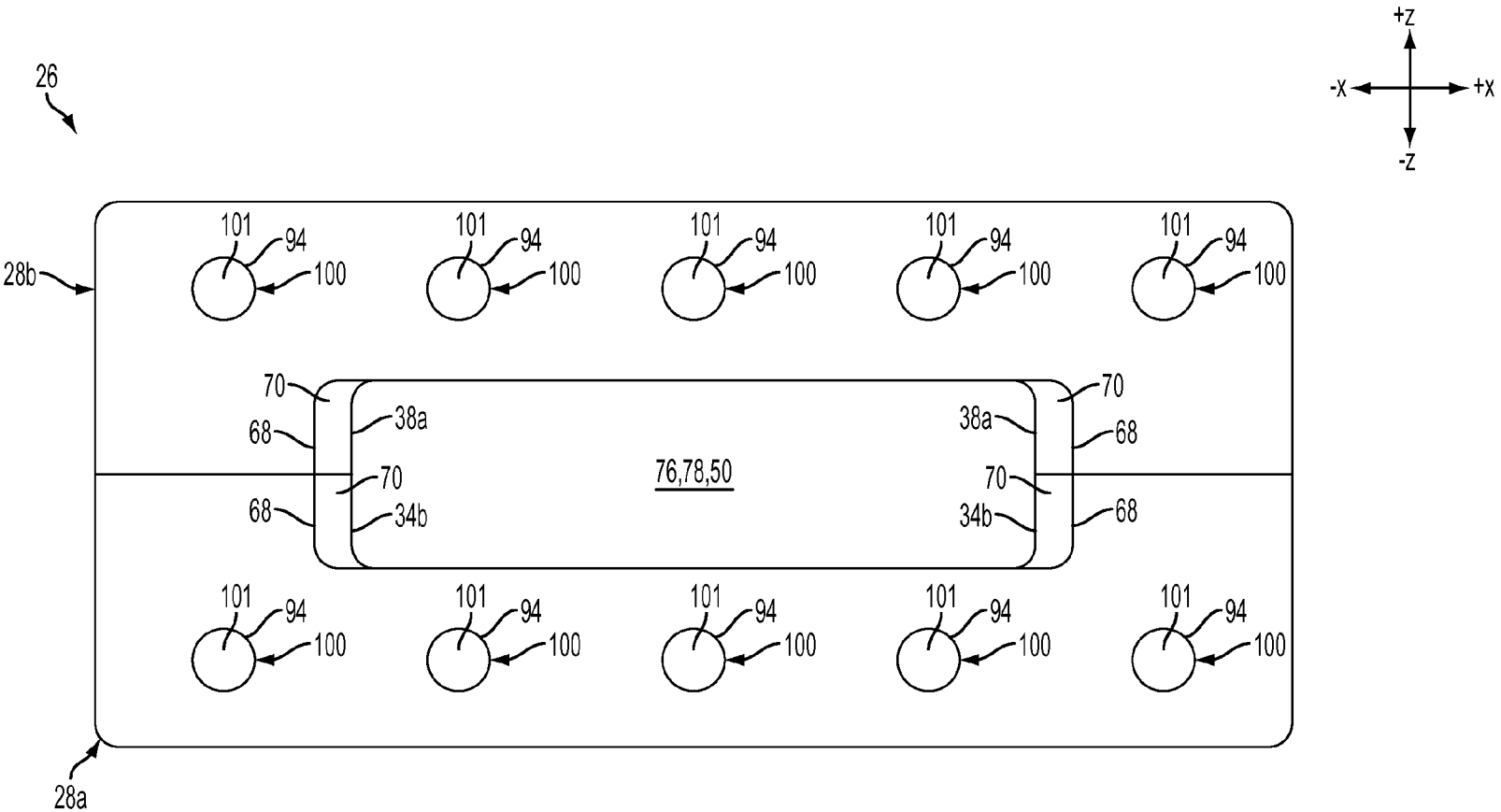
FIG. 8 is a front view of the shell shown in FIGS. 1A-7, depicting the shell in an assembled state.

The lips 68 of the first and second halves 28*a*, 28*b* of the shell 12 define a opening 76 in the shell 12 when the first and second halves 28*a*, 28*b* are mated, as depicted in FIGS. 2, 3, and 8. The opening 76 permits a mating portion 61 of the connector 15 to extend through the shell 12, as shown in FIGS. 2 and 3. The rearward portions of the side surfaces 34*a*, 34*b*, 38*a*, 38*b* likewise define an opening 78 in the shell 12 when the first and second halves 28*a*, 28*b* are mated. The opening 78 is depicted in FIGS. 1A, 1B, and 8. The opening 78 permits a strain-relief member and a cable of the connector 15 to extend through the shell 12, as shown in FIGS. 1A and 1B.

The first and second halves 28*a*, 28*b* are secured to each other by features that facilitate assembly and disassembly of the shell 12 by the user. In particular the first and second halves 28*a*, 28*b* each include two pairs of arms 80, as illustrated in FIGS. 5-7 and 9A-10. The arms 80 of the first half 28*a* project from a lower mating surface of 88*a* of the first half 28*a* as shown in FIG. 9A. The arms 80 of the second half 28*b* project from a lower mating surface of 90*a* of the second half 28*b*, as depicted in FIG. 9B. Holes 82 are formed in a lower mating surface 88*b* of the first half 28*s*, and in a lower mating surface 90*b* of the second half 28*b*. Each hole 82 in the lower mating surface 88*b* of the first half 28*a* receives an associated pair of the arms 80 of the second half 28*b* when the first and second halves 28*a*, 28*b* are mated. Each hole 82 in the lower mating surface 90*b* of the second half 28*b* receives an associated pair of the arms 80 of the first half 28*a* when the first and second halves 28*a*, 28*b* are mated.

Figure 10:
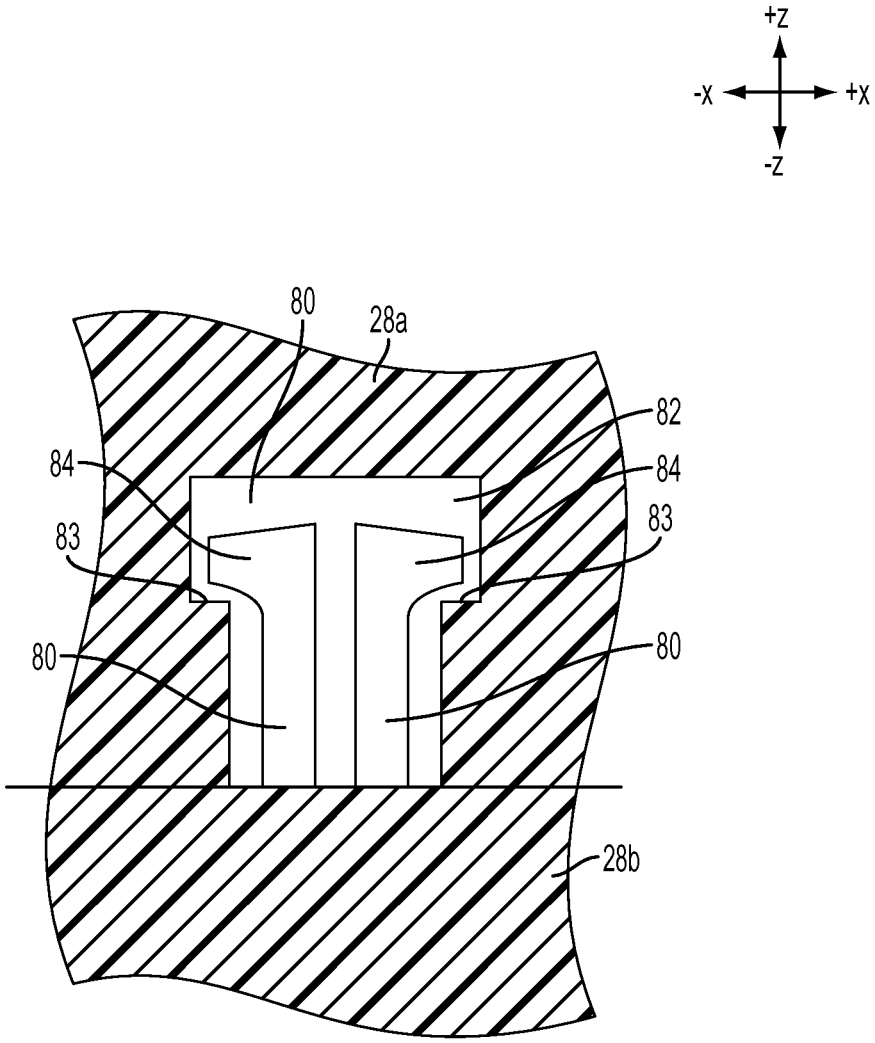
FIG. 10 is a cross-sectional view of the first and second halves of the shell shown in FIGS. 1A-9, depicting arms of the first half engaging the second half by way of a hole formed in the second half.

Each arm 80 has a barb 84 at a freestanding end thereof, as shown in FIGS. 7 and 9A-10. The exterior, or exposed end of each hole 82 is sized so that interference occurs between the periphery of the hole 82 and the barbs 84 of the associated arm 80 and as the first and second halves 28*a*, 28*b* of the shell 12 are mated. The interference causes each pair of arms 80 to deflect inwardly, toward each other, as the arm 80 enters its associated hole 82. The diameter of each hole 82 increases abruptly proximate an interior end thereof as shown in FIG. 10, so that a ledge 83 is formed between the smaller and larger-diameter portions of the hole 82. The resilience of the arms 80 causes each arm 80 to deflect or snap outwardly as its barbs 84 reach the larger-diameter portion of the associated hole 82 during mating of the first and second halves 28*a*, 28*b*, as depicted in FIG. 10. Interference between the ledge and the barbs 84 retains the arms 80 in their associated holes 82, thereby causing the first and second halves 28*a*, 28*b* of the shell 12 to remain in a mated condition.

The first and second halves 28*a*, 28*b* can subsequently be de-mated by prying the first and second halves 28*a*, 28*b* apart so as to cause the barbs 84 of each arm 82 to deflect inwardly when the prying force reaches a predetermined level, due to interference with the ledge within the associated hole 82. The underside of each barb 84 can be slightly tapered or angled in relation to the ledge 83 as shown in FIG. 10, to facilitate the inward movement of the barb 84 when the prying force reaches the predetermined level. The inward movement of the barbs 84 eliminates the interference between the barbs 84 and the ledge, thereby allowing the arms 80 to be withdrawn from the holes 82.

The first and second halves 28*a*, 28*b* of the shell 12 can be secured using means other than the arms 80 in alternative embodiments. For example, the first and second halves 28*a*, 28*b* can be secured using latches, fasteners such as bolts and nuts, or other suitable means. Also, the first and second halves 28*a*, 28*b* of alternative embodiments can be interconnected on a permanent basis by a suitable means such as a film hinge or other type of formed between or otherwise connected to the first and second halves 28*a*, 28*b*.

The shell 12 further includes magnetic elements in the form of ten permanent magnets 100. Five of the magnets 100 are mounted in the first half 28*a*, and an additional five of the magnets 100 are mounted in the second half 28*b*, as shown FIG. 4-8. Each magnet 100 is disposed in an associated recess 94 formed in the forward portion the first or second half 28*a*, 28*b*. The recesses 94 extend inwardly from a forward face 98*a* of the first half 28*a*, or a forward face 98*b* of the second half 28*b*. The magnets 100 are positioned so that a pole face 101 of each magnet 100 is substantially co-planar, i.e., flush, with respect to the forward face 98*a* of the first half 28*a* or the forward face 98*b* of the second half 28*b*. The pole faces 101 can be recessed or raised in relation to the forward faces 98*a*, 98*b* in alternative embodiments.

The magnets 100 are retained in the recesses 94 by adhesive. Other means for retaining the magnets 100, such as an interference fit, can be used in lieu of, or in addition to, adhesive. In alternative embodiments, each magnet 100 can be mounted within an associated sleeve formed from a ferrous material, and the sleeve can be embedded in an associated recess 94. The feature can help attenuate the amount of magnetic flux incident upon the connector 10 from the magnets 100.

The magnets 100 are N52 neodymium magnets having a diameter of approximately ⅛ inch. The overall number, type, size, and location of the magnets 100 is application-dependent, and can vary with factors such as the required or desired amount of attractive force between the shell 12 and the plate member 14, and the size and shape of the shell 12.

Figure 11:
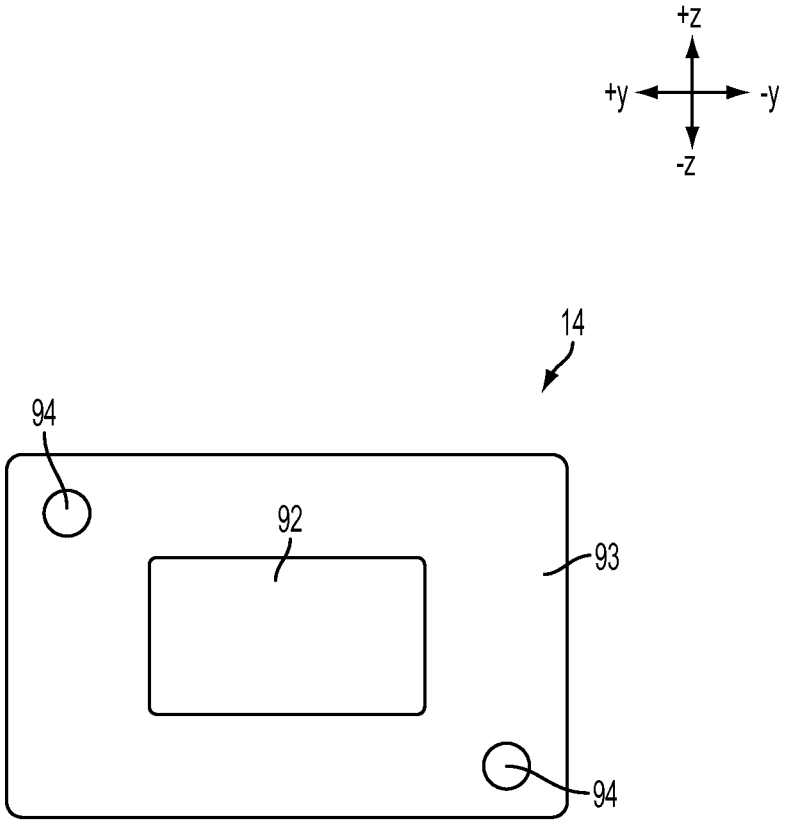
FIG. 11 is a front view of the plate member show in FIG. 1A.

The plate member 14 is mounted on an exterior of the notebook computer 18, around the receptacle 16, so that a substantially planar major surface 93 of the plate member 14 faces outwardly, as shown in FIG. 1A. The plate member 14 is formed from a ferromagnetic material such as stainless steel. The plate member 14 has a centrally-located opening 92 formed therein to provide access to the receptacle 16, as shown in FIG. 11. The plate member 14 is secured to the notebook computer 18 by screws that extend through recesses 94 formed in the plate member 14. The screws are accommodated by threaded holes in the receptacle 16. The plate member 14 can be secured to the notebook computer 18 using other suitable means, such as two-sided tape.

The connector 15 can be mated with the receptacle 16 after the shell 12 has been installed on the connector 15. In particular, the mating portion 61 of the connector 15 can be substantially aligned with the receptacle 16 as shown in FIGS. 1A and 2, and inserted into the receptacle in a mating or "+x" direction. The poles faces 101 of the magnets 100 are positioned adjacent the major surface 93 of the plate member 14 as the mating portion 61 reaches its fully-inserted position within the receptacle 16 shown in FIG. 1B. The pole faces 101 can contact, or can be minimally spaced from the major surface 93 when the connector 15 is fully mated with the receptacle 16, so that the plate member 14 is subjected to respective magnetic fields of the magnets 100. The resulting magnetic attraction between the magnets 100 and the ferromagnetic plate member 14 results in a force on the shell 12 that acts in the direction of insertion of the connector 15, i.e., in the "+x" direction. As discussed above, the connector body 60 is secured from substantial movement in relation to the shell 12 Thus, the attractive force between the magnets 100 and the plate member 14 helps to retain the mating portion 61 of the connector 15 and the receptacle 16 in a mated condition, shown in FIG. 1B. This force supplements the retaining force that normally arises due to friction between various contacting surfaces of the mating portion 61 and the receptacle 16.

A pull test was conducted to quantify the force required to remove a USB standard type A plug connector from a USB standard type A receptacle, with and without a shell substantially similar to the shell 12 described herein. The receptacle was installed in a notebook computer. A plate-member substantially similar to the plate member 14 was mounted on the notebook computer, around the periphery of the receptacle as described above. The retaining force on the plug connector, i.e., the force required to pull the fully-inserted mating portion of the connector out of the receptacle, was measured using an Instron Model 3365 scale. The scale was connected to the plug connector via the cable of the plug connector.

The results of the pull test demonstrated an increase in the retaining force on the plug connector of approximately four fold when the shell and plate member were used. More specifically, the average force required to de-mate the plug and receptacle, based on three pulls or mating/de-mating cycles, was approximately 1.1 pounds when the shell was not used. The average force required to de-mate the plug and receptacle, based on three pulls, was approximately 4.1 pounds when the shell was installed on the plug connector and the plate member was installed on the notebook computer.

It is believed that the substantial increase in retaining force available through the use of the shell 12 and plate member 14 can substantially reduce the occurrence of accidental and otherwise unintentional de-mating of USB connectors and other types of connectors and matable devices. Moreover, the configuration of the shell 12 allows the shell 12 to be retro-fit to existing connectors that otherwise do not have any means to supplement the retaining force associated therewith. In particular, a user can install the shell 12 on an existing connector 15 by placing the connector 15 in the second half 28*b* so that the sides of the connector body 60 substantially align with the side surfaces 38*a*, 38*b* of the second half 28*b*, and the bottom surface 66 of the connector body 60 rests on the lower surface 40 of the second half 28*b*. The mating surfaces 88*a*, 88*b* of the first half 28*a* can then be aligned with the respective mating surfaces 90*a*, 90*b* of the second half 28*b*. The first and second halves 28*a*, 28*b* can subsequently be moved toward each other so the arms 80 of the first and second halves 28*a*, 28*b* become disposed in their associated holes 82 on the other of the first and second halves 28*a*, 28*b*. The first and second halves 28*a*, 28*b* can be forced or squeezed together by hand, so that the barbs 84 on the arms 80 reach the ledge 83 within their associated hole 82, and deflect or snap outwardly to secure the first and second halves 28*a*, 28*b* to each other, thereby completing installation of the shell 12 on the connector 15.

The plate member 14 can be installed on the notebook computer 18 or other computing device using fasteners or other suitable means. The connector 15 at this point can be mated with the receptacle 16, and the shell 12 and plate member 14 will supplement the retaining force attributable to friction between contacting components of the connector 15 and the receptacle 16.

Moreover, the presence of the shell 12 and the plate member 14 does not necessitate any extra steps in the mating or de-mating processes for the connector 15 and the receptacle 16. Also, because the shell 12 and plate member 14 supplement the retaining force on the connector 15 without the use of mechanical interconnections, such as catches or latches, the connector 15 retains its break away capability, i.e., its ability to be quickly and easily de-mated from the receptacle 16.

The shell 12 and plate member 14 of alternative embodiments can be configured so that the magnetic elements associated therewith are mounted on the notebook computer 18 or other computing device that receives the connector 15, rather than on the connector 15. For example, in alternative embodiments of the plate member 14 and the shell 12, the entire plate member 14 can be formed from a magnetic material, and ferromagnetic elements can be mounted on or proximate the forward faces 98*a*, 98*b* of the of the shell 12 so that the magnetic plate member magnetically attracts the ferromagnetic elements when the connector 15 is mated with the receptacle 16. In other alternative embodiments, magnets, such as the magnets 100, can be embedded in a shell adapted to be mounted on the notebook computer 18, and a ferromagnetic plate member can be mounted on the connector 15 using a shell or other suitable means.

What is claimed is:

1. A kit for supplementing a retaining force between an electrical connector and a receptacle of a computing device, comprising:

a shell comprising: a body having a first half and a second half configured to mate with the first half; and a magnet mounted on the body; wherein the first half and the second half, when mated, define a cavity configured to receive at least a portion of the electrical connector in a manner that prevents substantial relative movement between the electrical connector and the body; and a ferromagnetic element configured to be mounted on the computing device proximate the receptacle so that the magnet is operable to attract the ferromagnetic element when the electrical connector and the receptacle are mated.

2. The kit of claim 1, wherein the first half of the body comprises a first and a second arm that extend from a mating surface thereof; the second half of the body has a hole formed therein and extending inwardly into the body from a mating surface of the second half; and the first and second arms and the hole are configured so that the first and second arms, when inserted into the hole, engage a periphery of the hole and operate to exert a force on the second half that urges the mating surface of the first half toward the mating surface of the second half.

3. The kit of claim 1, wherein the first and second arms are configured to disengage from the periphery of the hole when the arms are subjected to a predetermined force in a direction substantially opposite a direction of insertion of the arms into the hole.

4. The kit of claim 1, wherein the cavity has a shape and a size approximately equal to a respective shape and size of the portion of the electrical connector disposed in the cavity.

5. The kit of claim 4, wherein:

the first half of the body has a first and an opposing second side surface, and a lower surface that adjoins the first and second side surfaces;

the second half of the body has a first and an opposing second side surface, and a lower surface that adjoins the first and second side surfaces of the second half;

the first side surface of the first half is positioned adjacent the first side surface of the second half, the second side surface of the first half is positioned adjacent the second side surface of the second half, and the lower surface of the second half faces the lower surface of the first half when the first and second halves are mated; and the first and second side surfaces and the lower surface of the first half; and the first and second side surfaces and the lower surface of the second half define the cavity.

6. The kit of claim 1, wherein the ferromagnetic element is a plate having an opening formed therein, and the opening is configured to facilitate access to the receptacle when the ferromagnetic element is mounted on the computing device.

7. The kit of claim 1, where the body has a forward surface that faces a mating direction of the electrical connector when the electrical connector is disposed in the cavity, and the magnet is mounted on the body so that a pole face of the magnet faces the mating direction.

8. The kit of claim 7, wherein the shell comprises a total of ten magnets, five of the magnets are mounted on the first half of the shell, and five of the magnets are mounted on the second half of the shell.

9. A kit for increasing a retaining force between a first device and a second device configured to mate with the first device to establish an electrical connection between the first and second devices, the kit comprising:

a shell having a body configured to be assembled around at least a portion of the first device, the body being further configured to restrain the first device from substantial movement in relation to the body when the body is assembled around the first device; and a magnet and a ferromagnetic element, wherein: one of the magnet and the ferromagnetic element is mounted on the body and forms a part of the shell, and the other of the magnet and the ferromagnetic element is configured to be mounted proximate the second device; and the magnet and the ferromagnetic element are operable to generate a force that urges the first device toward the second device when the first and second devices are mated.

10. The kit of claim 9, wherein the body comprises a first half and a second half configured to mate with the first half, wherein the first and second halves comprise surfaces that define a cavity when the first and second halves are mated, the surfaces being configured to interfere with movement of the first device in relation to the body when the first device is disposed within the cavity.

11. The kit of claim 9, wherein the body is further configured to be disassembled and reassembled.

12. The kit of claim 9, wherein the magnet is mounted on the body; the ferromagnetic element is configured to be mounted proximate the second device; and the ferromagnetic element is a plate having an opening formed therein, the opening being configured to facilitate access to the second device when the ferromagnetic element is mounted proximate the second device.

13. The kit of claim 9, wherein the first device is a plug connector and the second device is a receptacle.

* * * * *